US010117504B2

(12) United States Patent
Bataillou et al.

(10) Patent No.: US 10,117,504 B2
(45) Date of Patent: Nov. 6, 2018

(54) WEARABLE BAND INCLUDING MAGNETS

(71) Applicant: Apple Inc., Cupertino, CA (US)

(72) Inventors: Jeremy D. Bataillou, Cupertino, CA (US); Richard D. Kosoglow, Cupertino, CA (US); Sean S. Corbin, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 256 days.

(21) Appl. No.: 14/701,615

(22) Filed: May 1, 2015

(65) Prior Publication Data

US 2016/0037897 A1 Feb. 11, 2016

Related U.S. Application Data

(60) Provisional application No. 62/035,419, filed on Aug. 9, 2014, provisional application No. 62/035,999, filed on Aug. 11, 2014.

(51) Int. Cl.

| | |
|---|---|
| ***A45F 5/00*** | (2006.01) |
| ***A44C 5/20*** | (2006.01) |
| ***H01F 7/02*** | (2006.01) |

(52) U.S. Cl.

CPC ..... *A45F 5/00* (2013.01); *A44C 5/20* (2013.01); *A44C 5/2071* (2013.01); *H01F 7/0263* (2013.01); *A44D 2203/00* (2013.01); *A45F 2005/008* (2013.01)

(58) Field of Classification Search

CPC ..... A45F 5/00; A45F 2005/008; A44C 5/20; A44C 5/2071; H01F 7/0263; A44D 2203/00

USPC ..... 224/267

See application file for complete search history.

(56) References Cited

U.S. PATENT DOCUMENTS

| | | | | |
|---|---|---|---|---|
| 3,579,159 | A | 5/1971 | Posey | |
| 3,815,066 | A | 6/1974 | Vinal | |
| 3,873,957 | A | 3/1975 | Wurscher et al. | |
| 3,906,417 | A | 9/1975 | Serras-Paulet | |
| 3,938,642 | A | 2/1976 | Van Rumpt et al. | |
| 4,054,944 | A | 10/1977 | Lau | |
| 4,280,214 | A | 7/1981 | Kunii et al. | |
| 4,399,595 | A * | 8/1983 | Yoon | A41F 1/002 24/303 |

(Continued)

FOREIGN PATENT DOCUMENTS

| | | |
|---|---|---|
| CN | 2497586 | 7/2002 |
| CN | 1395896 | 2/2003 |

(Continued)

*Primary Examiner* — Peter Helvey

(74) *Attorney, Agent, or Firm* — Morgan, Lewis & Bockius LLP

(57) ABSTRACT

A wearable band for an electronic device and a method of forming the wearable band for the electronic device. The wearable band may include a first strap portion including a loop, and a second strap portion positioned through the loop of the first strap portion. The second strap portion may include a first group of components positioned adjacent a first end of the second strap portion. The first group of components may include magnetic properties. The second strap portion may also include a second group of components positions adjacent a second end, opposite the first end, of the second strap portion. The second group of components may include magnetic properties.

29 Claims, 12 Drawing Sheets

(56) References Cited

U.S. PATENT DOCUMENTS

| | | | | |
|---|---|---|---|---|
| 4,453,148 | A | 6/1984 | Norakidze et al. | |
| 4,868,530 | A | 9/1989 | Ahs | |
| 4,941,236 | A | 7/1990 | Sherman et al. | |
| 5,076,623 | A | 12/1991 | Richards | |
| 5,323,516 | A | 6/1994 | Hartmann | |
| 5,349,725 | A | 9/1994 | Levy | |
| 5,367,891 | A | 11/1994 | Furuyama et al. | |
| 5,682,653 | A * | 11/1997 | Berglof | G09F 1/10 224/183 |
| 5,889,737 | A | 3/1999 | Alameh et al. | |
| 5,977,888 | A | 11/1999 | Fujita et al. | |
| 6,050,931 | A | 4/2000 | Russell | |
| 6,412,116 | B1 * | 7/2002 | Clark | A41F 1/002 2/129 |
| 6,598,271 | B2 | 7/2003 | Nire | |
| 6,598,272 | B2 | 7/2003 | Nire | |
| 6,647,597 | B2 * | 11/2003 | Reiter | A41F 1/002 24/303 |
| 7,043,740 | B2 | 5/2006 | Chen et al. | |
| 7,152,282 | B2 | 12/2006 | Costa et al. | |
| 7,308,737 | B2 | 12/2007 | Saitoh et al. | |
| 7,496,994 | B1 | 3/2009 | Headley et al. | |
| 7,667,623 | B2 | 2/2010 | Soh et al. | |
| 7,708,456 | B2 | 5/2010 | Kraus et al. | |
| 8,467,270 | B2 | 6/2013 | Gossweiler, III et al. | |
| 8,505,334 | B2 | 8/2013 | Niikura | |
| 8,717,132 | B2 | 5/2014 | Lancaster-Larocque | |
| 8,937,520 | B2 | 1/2015 | Kan | |
| 8,957,751 | B2 | 2/2015 | Fullerton et al. | |
| 8,978,213 | B2 | 3/2015 | Hayton | |
| 8,985,410 | B2 | 3/2015 | Wishart | |
| 8,994,827 | B2 | 3/2015 | Mistry et al. | |
| 8,997,318 | B2 | 4/2015 | Nicolas et al. | |
| 9,089,193 | B2 | 7/2015 | Casini | |
| 9,125,460 | B2 * | 9/2015 | Olsen | A44C 5/2071 |
| 9,141,086 | B1 | 9/2015 | Rohrbach | |
| 9,392,829 | B2 * | 7/2016 | Manuello | A41F 1/002 |
| 9,404,776 | B2 * | 8/2016 | Fullerton | H01F 7/021 |
| 9,585,445 | B2 * | 3/2017 | Qian | A44B 11/258 |
| 9,609,921 | B1 * | 4/2017 | Feinstein | A44C 5/2071 |
| 2002/0104151 | A1 | 8/2002 | Rauscher | |
| 2003/0229974 | A1 | 12/2003 | Zemer et al. | |
| 2005/0102802 | A1 * | 5/2005 | Sitbon | A41F 1/002 24/303 |
| 2006/0257190 | A1 | 11/2006 | Chiang | |
| 2011/0048069 | A1 | 3/2011 | Komatsu | |
| 2013/0326790 | A1 | 12/2013 | Cauwels et al. | |
| 2014/0033482 | A1 | 2/2014 | Fullerton et al. | |
| 2014/0077910 | A1 | 3/2014 | Chaizy | |
| 2016/0037875 | A1 | 2/2016 | Rohrbach | |
| 2016/0037879 | A1 | 2/2016 | Qian et al. | |
| 2016/0037896 | A1 | 2/2016 | Kosoglow et al. | |
| 2016/0037897 | A1 | 2/2016 | Bataillou et al. | |
| 2016/0042897 | A1 | 2/2016 | Qian | |

FOREIGN PATENT DOCUMENTS

| | | | |
|---|---|---|---|
| CN | 1758863 | A | 4/2006 |
| CN | 1794931 | | 6/2006 |
| CN | 101657120 | | 2/2010 |
| CN | 201440767 | | 4/2010 |
| CN | 201683167 | | 12/2010 |
| CN | 101384975 | | 3/2011 |
| CN | 201846934 | U | 6/2011 |
| CN | 202154152 | | 3/2012 |
| CN | 102481034 | | 5/2012 |
| CN | 202233407 | | 5/2012 |
| CN | 202533728 | | 11/2012 |
| CN | 103164044 | | 6/2013 |
| CN | 203314250 | | 12/2013 |
| CN | 103504731 | | 1/2014 |
| CN | 203469237 | | 3/2014 |
| CN | 103815628 | A | 5/2014 |
| CN | 204838302 | | 12/2015 |
| DE | 2323058 | | 11/1974 |
| EP | 1 133 936 | A1 | 9/2001 |
| EP | 1980170 | | 10/2008 |
| EP | 2532262 | | 12/2012 |
| GB | 2099762 | | 12/1982 |
| JP | H10165211 | | 6/1998 |
| JP | 2004166895 | | 6/2004 |
| JP | 2011078524 | | 4/2011 |
| KR | 1020050105950 | | 4/2006 |
| WO | WO2007/114631 | | 10/2007 |
| WO | WO2013090198 | | 6/2013 |
| WO | WO03/056956 | | 7/2013 |
| WO | WO2015/028044 | | 3/2015 |

* cited by examiner

WEARABLE BAND INCLUDING MAGNETS

CROSS-REFERENCE TO RELATED APPLICATION

This application is a nonprovisional patent application of and claims the benefit to U.S. Provisional Patent Application No. 62/035,419, filed Aug. 9, 2014, entitled "Wearable Band Including Magnets," and U.S. Provisional Patent Application No. 62/035,999, filed Aug. 11, 2014, entitled "Wearable Band Including Magnets," the disclosures of which are hereby incorporated herein by reference in their entirety.

TECHNICAL FIELD

The disclosure relates generally to electronic devices, and more particularly to a wearable band for an electronic device and a method of forming the wearable band for the electronic device.

BACKGROUND

Conventional wearable electronic devices include bands that couple the electronic device to a user or a desired object for holding the electronic device (e.g., bicycle handlebar). For example, a conventional wristwatch typically includes a band that attaches the watch to a user's wrist. There are many varieties of conventional wearable bands for watches including, but not limited to, elastic bands, flexible bands including buckles, and metal bands including metal clasp. However, each of these conventional bands may include negative aspects, and may undesirably fail prior to the end of the expected operational life of the wearable electronic device.

For example, the conventional elastic band may lose its elastic properties over time, and may become too big for a user's wrist, which may result in the electronic device unexpectedly slipping from a user's wrist and being damaged. In another example, the material forming the flexible bands may tear or deteriorate over time due to normal use over the operational life of the band and/or the concentrated force applied at the hole of the flexible band by the tongue of the buckle. The metal bands including the metal clasp may include a plurality of components all coupled together, which may fail, become uncoupled or malfunction over time. That is, the plurality of components forming the metal band may become damaged, not function properly over time, or may become uncoupled, rendering the metal band incapable of attaching the wearable electronic device to a user. When a conventional wearable band fails and/or is incapable of securely attaching the electronic device to a user's wrist, the band needs to be replaced and/or the wearable electronic device may be susceptible to damage.

SUMMARY

Generally, embodiments discussed herein are related to a wearable band for an electronic device, and methods of forming the wearable band for the electronic device. The wearable band may include two strap portions coupled to a wearable electronic device. The first strap portion may include a loop and the second strap portion, capable of being inserted through the loop of the first strap portion, may include a plurality of components having magnetic properties (e.g., magnets, ferrous metals). The wearable electronic device including the wearable band may be secured to an object (e.g., user's wrist) by inserting the second strap portion through the loop of the first strap portion and releasably coupling the components of the second strap portion to one another. A group of magnets positioned at a first end of the second strap portion may be magnetically coupled to a distinct group of magnets positioned at a second end, opposite the first end, after the second end is positioned through the loop of the first strap portion and folded back on the remainder of the second strap portion. By utilizing magnets, the magnetic bond or coupling formed between the plurality of components in the second strap portion may not substantially weaken or fail over time. Additionally, as a result of the components being included in and/or encased within the second strap portion, the risk of mechanical failure (e.g., loss or damage of components) may be substantially minimized.

One embodiment may include a wearable band. The wearable band may include a first strap portion including a loop, and a second strap portion positioned through the loop of the first strap portion. The second strap portion may include a first group of components positioned over a first length of the second strap portion. The first group of components may include magnetic properties. The second strap portion may also include a second group of components positioned over a second length of the second strap, distinct from the first length. The second group of components may include magnetic properties.

Another embodiment may include a wearable electronic device. The wearable electronic device may include a housing, and a wearable band coupled to the housing. The wearable band may include a first strap portion including a loop coupled to a first portion of the housing, and a second strap portion coupled to a second portion, opposite the first portion, of the housing. The second strap portion may include a first group of magnets positioned adjacent a first end of the second strap portion, a second group of magnets positioned adjacent a second end of the second strap portion. The second group of magnets may be positioned opposite the first group of magnets, and a plurality of inserts positioned between the first group of magnet and the second group of magnets. The plurality of inserts may include magnetic properties.

A further embodiment may include a method of forming a wearable band for a wearable electronic device. The method may include coupling a plurality of components to a protective layer. The plurality of components may include magnetic properties. The method may also include coupling filler material to at least one of the protective layer and the plurality of components to form an internal assembly, and positioning the internal assembly within a strap of the wearable electronic device.

BRIEF DESCRIPTION OF THE DRAWINGS

The disclosure will be readily understood by the following detailed description in conjunction with the accompanying drawings, wherein like reference numerals designate like structural elements, and in which.

Figure 1:
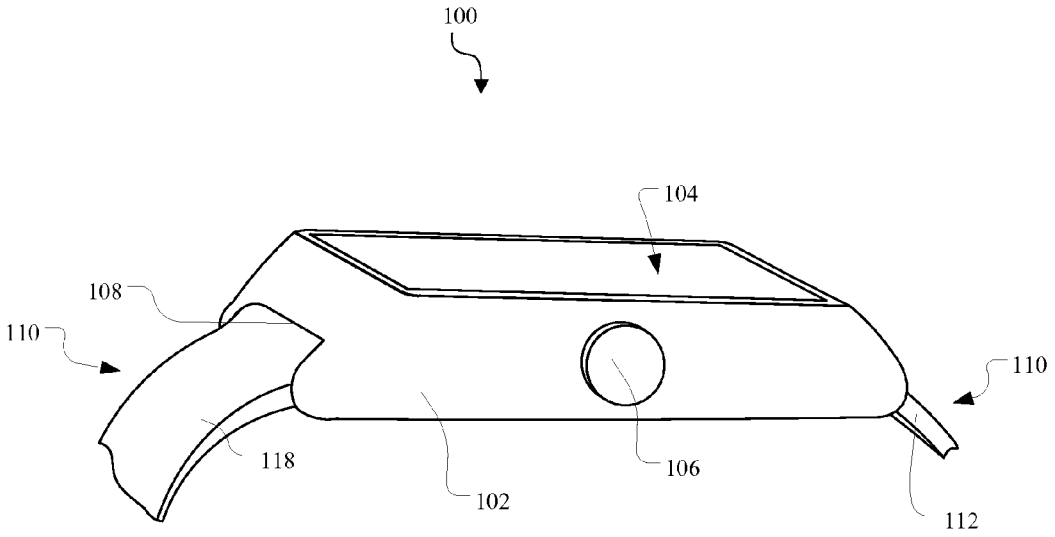
FIG. 1 depicts an illustrative perspective view of a wearable electronic device including a portion of a wearable band, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to an electronic device, and more particularly, to a wearable band for an electronic device and a method of forming the wearable band for the electronic device.

The wearable band may include two strap portions coupled to a wearable electronic device. The first strap portion may include a loop and the second strap portion, capable of being inserted through the loop of the first strap portion, may include a plurality of components having magnetic properties (e.g., magnets, ferrous metals). The wearable electronic device including the wearable band may be secured to an object (e.g., user's wrist) by inserting the second strap portion through the loop of the first strap portion and releasably coupling the components of the second strap portion to one another. A group of magnets positioned at a first end of the second strap portion may be magnetically coupled to a distinct group of magnets positioned at a second end, opposite the first end, after the second end is positioned through the loop of the first strap portion and folded back on the remainder of the second strap portion. By utilizing magnets, the magnetic bond or coupling formed between the plurality of components in the second strap portion may not substantially weaken or fail over time. Additionally, as a result of the components being included in and/or encased within the second strap portion, the risk of mechanical failure (e.g., loss or damage of components) may be substantially minimized.

These and other embodiments are discussed below with reference to FIGS. 1-12. However, those skilled in the art will readily appreciate that the detailed description given herein with respect to these Figures is for explanatory purposes only and should not be construed as limiting.

FIG. 1 shows an illustrative perspective view of a portable or wearable electronic device 100, according to embodiments. Wearable electronic device 100, as shown in FIG. 1, may be configured to provide health-related information or data such as, but not limited to, heart rate data, blood pressure data, temperature data, oxygen level data, diet/nutrition information, medical reminders, health-related tips or information, or other health-related data. The wearable electronic device may optionally convey the health-related information to a separate electronic device such as a tablet computing device, phone, personal digital assistant, computer, and so on. In addition, wearable electronic device 100 may provide additional information, such as but not limited to, time, date, health, statuses or externally connected or communicating devices and/or software executing on such devices, messages, video, operating commands, and so forth (and may receive any of the foregoing from an external device), in addition to communications.

Wearable electronic device 100 may include a housing 102 at least partially surrounding a display 104 and one or more buttons 106 or input devices. The housing 102 may form an outer surface or partial outer surface and protective case for the internal components of wearable electronic device 100, and may at least partially surround the display 104. The housing 102 may be formed of one or more components operably connected together, such as a front piece and a back piece. Alternatively, the housing 102 may be formed of a single piece operably connected to the display 104. Housing 102 may include a plurality of distinct materials including, but not limited to: corundum, commonly referred to as sapphire, metal, glass or plastic. Additionally, housing 102 may include a decorative and/or coating layer that be disposed on the outer and/or or inner surface of housing 102. The decorative layer and/or coating layer may be disposed on the surface(s) of housing 102 to protect the enclosure and/or provide a decorative feature (e.g., exterior color) for electronic device 100.

Housing 102 may also include recesses 108 formed on opposite ends to connect a wearable band 110 (partially shown in FIG. 1) to wearable electronic device 100. As shown in FIG. 1, and discussed herein, wearable band 110 may include a first strap portion 112 coupled to housing 102, and a second strap portion 118 positioned opposite first strap portion 112 and coupled to housing 102. Wearable band 110, and specifically first strap portion 112 and second strap portion 118, may be used to secure wearable electronic device 100 to a user, or any other object capable of receiving wearable electronic device 100. In a non-limiting example where wearable electronic device 100 includes a smart watch, wearable band 110 may secure the watch to a user's wrist. In other non-limiting examples, wearable electronic device 100 may secured to another part of a user's body using wearable band 110. Additionally in other non-limiting examples discussed herein, wearable band 110 may be formed as a single component coupled to housing 102 or as two distinct components coupled to opposite ends of housing 102.

Display 104 may be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology.

Button 106 may include any suitable input/output (I/O) device for electronic device 100. Specifically, button 106 may include an actuation component in electronic and/or mechanical communication with the internal components of electronic device 100, to provide user input and/or allow the user to interact with the various functions of electronic device 100. In an embodiment button 106 may be configured as a single component surrounded by housing 102. Alternatively, button 106 may include a plurality of components, including an actuation component, in mechanical/electrical communication with one another and/or internal component of electronic device 100.

Figure 2:
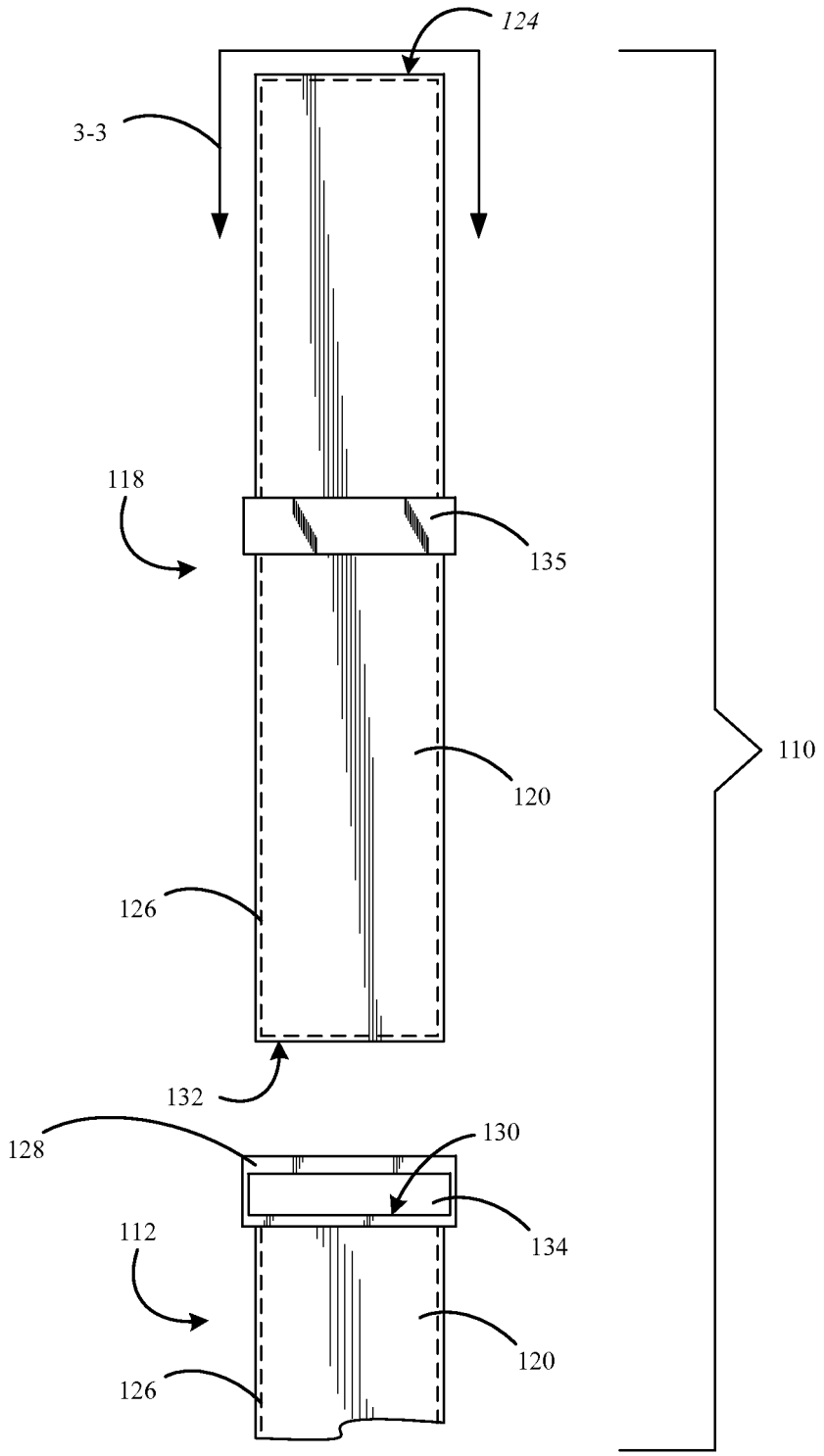
FIG. 2 shows an illustrative top view of the wearable band as shown in FIG. 1, according to embodiments of the invention.

FIG. 2 shows an illustrative top view of wearable band 110 of FIG. 1. Specifically, FIG. 2 may show first strap portion 112 and second strap portion 118 forming wearable band 110 for wearable electronic device 100. First strap portion 112 and second strap portion 118 may be formed from substantially the same material or any material including similar flexible and/or deformable characteristics. In a non-limiting example, first strap portion 112 and second strap portion 118 may be formed from a leather material.

First strap portion 112 and second strap portion 118 may be formed from a top layer 120 and a bottom layer 122 (see, FIG. 4) of material (e.g., leather) bonded or coupled to one another. First strap portion 112 and second strap portion 118 may be formed using a single piece of material or multiple pieces of material, where first strap portion 112 and second strap portion 118 include top layer 120 and bottom layer 122. In a non-limiting example, each of first strap portion 112 and second strap portion 118 may be formed from single, distinct pieces of material. The single piece of material may be folded over itself to form top layer 120 and bottom layer 122, and the folded portion may be positioned at a housing end 124 (e.g., second strap portion 118). Housing end 124 of first strap portion 112 (not shown) and/or second strap portion 118 may be coupled to and/or positioned within recess 108 to couple wearable band 110, and specifically first strap portion 112 and second strap portion 118, to housing 102 of wearable electronic device 100 (see, FIG. 1). In another non-limiting example, first strap portion 112 and second strap portion 118 may be formed from multiple pieces of material, where each distinct piece of material forms top layer 120 or bottom layer 122 for first strap portion 112 and/or second strap portion 118. In an additional non-limiting example discussed herein, wearable band 110 may be formed from a single piece of material, such that first strap portion 112 and second strap portion 118 are integrally formed.

First strap portion 112 and second strap portion 118 may include a coupling component 126 (shown in phantom) positioned substantially around and/or adjacent to the perimeter of the respective strap portions. Coupling component 126 may include an suitable material or technique that may be used to couple top layer 120 and bottom layer 122 to one another to form first strap portion 112 and/or second strap portion 118. Additionally, and as discussed herein, coupling component 126 may be utilized within first strap portion 112 and/or second strap portion 118 to ensure internal components of the respective straps remain within and/or between top layer 120 and bottom layer 122. In a non-limiting example, coupling component 126 may include an adhesive or bonding adjacent positioned adjacent the perimeter of first strap portion 112 and/or second strap portion 118 to bond top layer 120 to bottom layer 122. In another non-limiting example, coupling component 126 may include a thread that may pass through top layer 120 and bottom layer 122 around the perimeter of first strap portion 112 and/or second strap portion 118 to couple top layer 120 to bottom layer 122.

As shown in FIG. 2, first strap portion 112 may include a loop 128 positioned at an end 130 adjacent a second strap portion 118. As discussed herein, a free end 132 of second strap portion 118 may be feed and/or positioned through opening 134 of loop 128, and a portion of second strap portion 118 may be fold back on itself to couple wearable electronic device 100 (see, FIG. 1) to a user or a desired object. In a non-limiting example, loop 128 may be formed from a distinct material or component that may be coupled to the material forming first strap portion 112 (see, FIG. 2). In a non-limiting example shown in FIG. 2, loop 128 may be a distinct component from first strap portion 112, and may be formed from a material having magnetic properties. In the non-limiting example, loop 128 may be formed from a ferrous metal material, and may be coupled to end 130 of first strap portion 112 using any suitable coupling component and/or technique (e.g., thread, adhesive, melting and so on). As discussed herein, loop 128 of first strap portion 112 may be formed from a material having magnetic properties to prevent free end 132 of second strap portion 118 from being completely and/or undesirably removed from loop 128 during use of wearable electronic device 100 (see, FIG. 1).

As shown in FIG. 2, wearable band 110 may also include a retention loop 135 positioned on and/or substantially around second strap portion 118. As discussed herein, retention loop 135 may aid in securing free end 132 and/or a portion of second strap portion 118 to the remainder of second strap portion 118 when free end 132 is positioned through loop 128 and folded back onto the remaining portion of second strap portion 118. Retention loop 135 may form an opening (not shown) located between second strap portion 118 of wearable band assembly 110 and retention loop 135, where the opening may receive free end 132 and/or a portion of second strap portion 118. In a non-limiting example, retention loop 135 may be coupled to and/or fixed in a predetermined position of second strap portion 118. In another non-limiting example, retention loop 135 may surround second strap portion 118, and may be free to move over the length of second strap portion 118 of wearable band 110.

Figure 3:
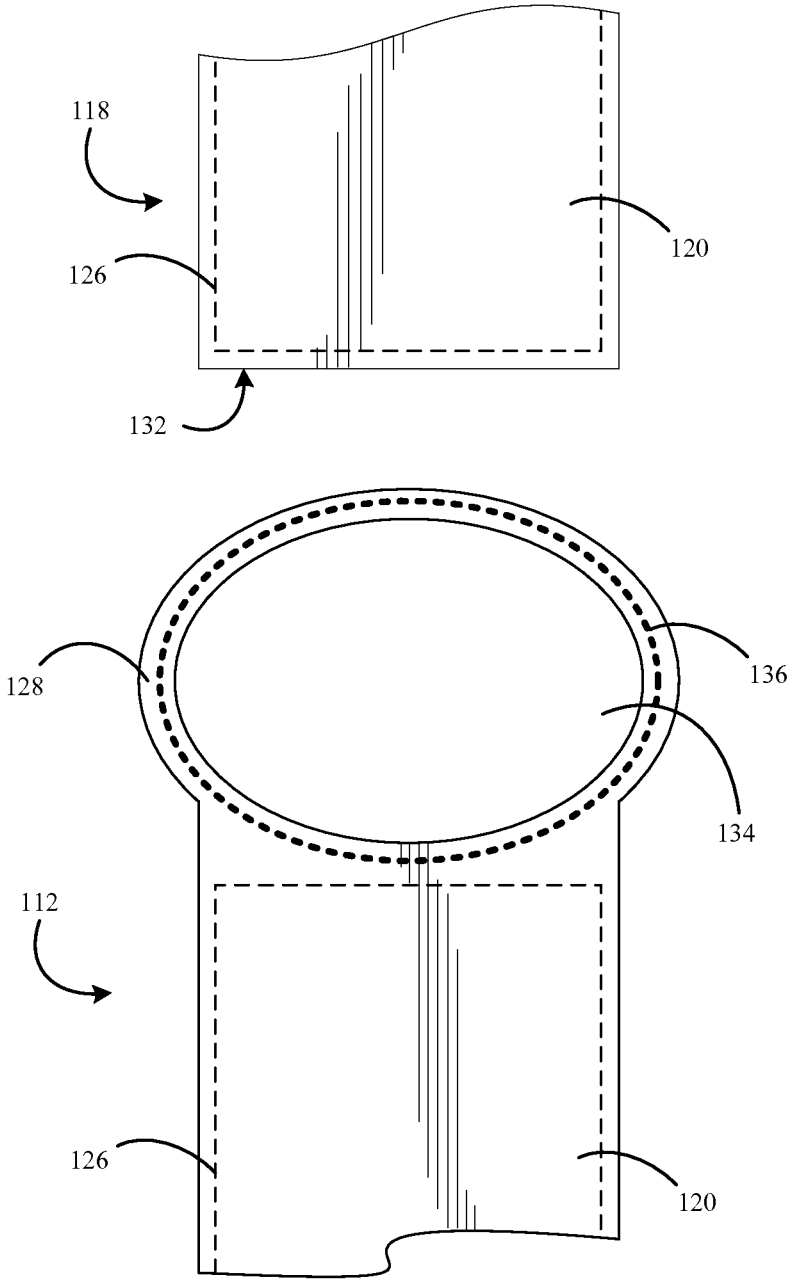
FIG. 3 shows an enlarged top view of a portion of a first strap portion and a second strap portion of the wearable band as shown in FIG. 2, according to additional embodiments of the invention.

In another non-limiting example, as shown in FIG. 3, loop 128 may be formed integrally with first strap portion 112. More specifically, loop 128 may be formed from the same material forming first strap portion 112, and may include top layer 120 and bottom layer 122 (see, FIG. 4), as similarly discussed herein with respect to first strap portion 112. As shown in FIG. 3, opening 134 of loop 128 may be formed through the material forming loop 128 and/or first strap portion 112 and may receive free end 132 of second strap portion 118.

As shown in FIG. 3, where loop 128 is integrally formed with first strap portion 112, loop 128 may include reinforcing fibers 136 (shown in phantom). More specifically, reinforcing fibers 136 may be positioned within at least a portion of loop 128 and/or may substantially surround at least a portion of opening 134 of loop 128. In a non-limiting example, as shown in FIG. 3, reinforcing fibers 136 may be positioned around an entire circumference of loop 128 and/or opening 134 of loop 128. In another non-limiting example, not shown, reinforcing fibers may be positioned within two opposite portions of the circumference of loop 128 and/or opening 134. In the non-limiting example, reinforcing fibers 136 may be positioned within a first portion of loop 128 positioned directly adjacent free end 132 of second strap portion 118, and an opposition portion of loop 128 positioned directly adjacent the body of first strap portion 112.

Reinforcing fibers 136 may be made from a flexible material that may be woven through top layer 120 and bottom layer 122 of material forming loop 128, to provide additional support to loop 128 during use of wearable band 110. That is, reinforcing fibers 136 may provide additional support to loop 128 of first strap portion 112 to minimize a pull stress placed on loop 128 by second strap portion 118 when wearable electronic device 100 is being used. As similar discussed herein with respect to FIG. 2 and as discussed in detail below, reinforcing fibers 136 may be formed from a material having magnetic properties to prevent free end 132 of second strap portion 118 from being completely and/or undesirably removed from loop 128 during use of wearable electronic device 100 (see, FIG. 1).

Figure 4:
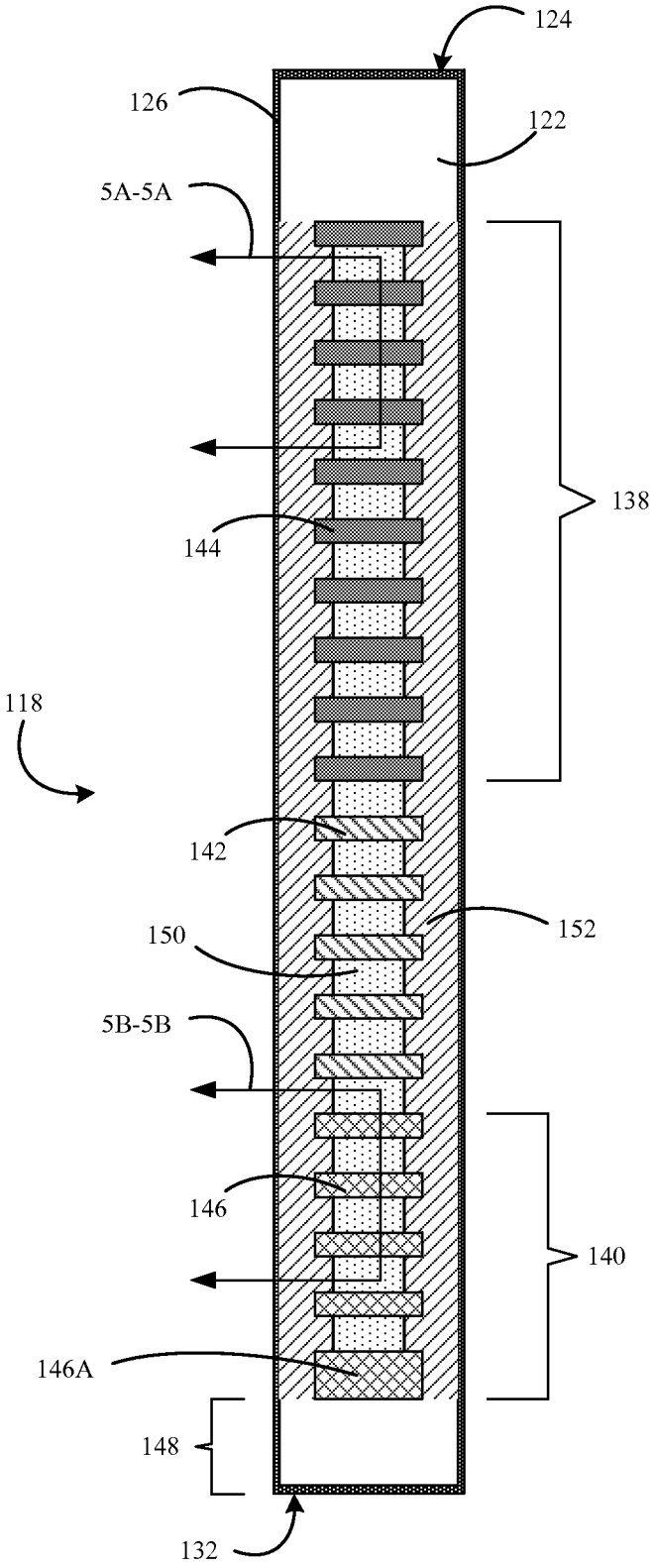
FIG. 4 shows a cross-section top view of a strap of the wearable band taken along line 4-4 of FIG. 2, according to embodiments of the invention.

FIG. 4 shows a cross-section top view of second strap portion 118 of wearable band 110 taken along line 4-4 of FIG. 2. Specifically, FIG. 4 shows second strap portion 118 with top layer 120 removed. As shown in FIG. 4, and as discussed herein with respect to FIG. 2, coupling component 126 may be positioned substantially around and/or substantially adjacent to a perimeter of second strap portion 118. Coupling component 126 may include an adhesive or bonding agent that may positioned on bottom layer 122 of second strap portion 118, and may couple or bond bottom layer 122 to top layer 120 (see, FIG. 2) to form second strap portion 118. The adhesive or bonding agent forming coupling component 126 may be any suitable adhesive capable of coupling the material forming top layer 120 and bottom layer 122 of second strap portion 118.

Second strap portion 118 may include a plurality of components 138, 140 and inserts 142. More specifically, as shown in FIG. 4, second strap portion 118 may include a first group of components 138 positioned adjacent housing end 124, and a second group of component 140 positioned adjacent free end 132, opposite first group of component 138. Second strap portion 118 may also include a plurality of inserts 142 positioned between first group of component 138 and second group of components 140. The first group of components 138, the second group of components 140 and the plurality of inserts 142 may be positioned within second strap portion 118 between top layer 120 (see, FIG. 2) and bottom layer 122.

The first group of components 138, the second group of components 140 and the plurality of inserts 142 may all include magnetic properties. That is, each of the components 138, 140 and inserts 142 may all be formed from a material that may include magnetic properties (e.g., magnetic field, magnetic attraction, and so on). In non-limiting examples, first group of components 138 may include a plurality of first magnets 144 having a first magnetic field, and second group of components 140 may include a plurality of second magnets 146 having a second magnetic field distinct from the first magnetic field of the first magnets 144. The second magnetic field of the second magnets 146 of the second group of component 140 may be distinct (for example, larger) than the first magnetic field of the first magnets 144 of the first group of component 138. Additionally in a non-limiting example, the plurality of inserts 142 may be formed from a ferrous metal material and may be magnetically attracted to second magnets 146 of the second group of components 140. As discussed in detail below, second magnets 146 of the second group of components 140 may be magnetically attracted and/or coupled to first magnets 144 of the first group of components 138 and/or the plurality of inserts 142 for coupling wearable electronic device 100 (see, FIG. 1) including wearable band 110 to a user.

As shown in FIG. 4, the number of first magnets 144 in first group of components 138 included in second strap portion 118 may be larger than the number of second magnets 146 in second group of components 140 and/or the number of inserts in the plurality of inserts 142. As a result, first magnets 144 in first group of components 138 may be positioned over the majority of second strap portion 118. In a non-limiting example, as shown in FIG. 4, first magnets 144 in first group of components 138 may be positioned over approximately half of a length of second strap portion 118. Second magnets 146 in second group of components 140 and the plurality of inserts 142 may span or be positioned over the remainder of the length of second strap portion 118. In a non-limiting example, second magnets 146 in second group of components 140 may be positioned over at least a quarter of the length of second strap portion 118. Additionally, the plurality of inserts 142 may be positioned over the remaining portion of second strap portion 118 between first group of components 138 and second group of components 140.

It is understood that the number of components 138, 140 or magnets 144, 146 and/or inserts 142 shown in FIG. 4 may be merely exemplary. That is, the number of components, magnets and/or inserts shown in FIG. 4 may be merely exemplary for clearly and completely describing the disclosure, and may not represent the actual number of components, magnets and/or inserts used to form wearable band 110 for wearable electronic device 100 (see, FIG. 1).

As shown in FIG. 4, second magnets 146 of second group of components 140 man include an enlarged second magnet 146A positioned directly adjacent free end 132 of second strap portion 118. Enlarged second magnet 146A may be substantially larger than the remaining second magnets 146 of second group of components 140. Additionally, enlarged second magnet 146A may be substantially larger than the remaining first magnets 144 of first group of components 138, and/or the plurality of inserts 142 of second strap portion 118. Enlarged second magnet 146A may be larger than the remaining second magnets 146 of second group of components 140 to produce a stronger magnetic field or flux, and to ultimately ensure that the portion of second strap portion 118 including enlarged second magnet 146A is magnetically coupled to a distinct first magnet 144 and/or insert 142, as discussed herein. Additionally, as a result of the stronger magnetic field or flux of enlarged second magnet 146A, enlarged second magnet 146A may be magnetically coupled and/or attracted to loop 128 of first strap portion 112 (see, FIG. 2). This magnetic coupling/attraction to loop 128 may substantially prevent free end 132 of second strap portion 118 from being easily and/or undesirably removed from loop 128 when wearable electronic device 100 including wearable band 110 (see, FIG. 1) is taken off of a user and/or wearable band 110 is adjusted.

To aid in the positioning of free end 132 of second strap portion 118 through loop 128, second strap portion 118 may also include a length of excess material 148 between free end 132 and second magnets 146 of second group of components 140. Excess material 148 may provide a user a portion of material to grab that is not magnetically attracted to loop 128 of first strap portion 112, when positioning free end 132 of second strap portion 118 through loop 128. The excess material 148 may aid in position free end 132 through loop 128 to magnetically couple second magnets 146 of second group of components 140 with first magnets 144 of first group of components 138 and/or the plurality of inserts 142, and ultimately couple wearable electronic device 100 to a user, as discussed herein.

As shown in FIG. 4, second strap portion 118 may also include a protective layer 150. Protective layer 150 may be coupled to the various components 138, 140 and/or inserts 142 positioned within second strap portion 118. In a non-limiting example, protective layer 150 may be coupled to first magnets 144 of first group of components 138, second magnets 146 of second group of components 140 and/or the plurality of inserts 142 positioned within second strap portion 118. Additionally, and as shown in FIG. 4, protective layer 150 may be positioned between first magnets 144 of first group of components 138, second magnets 146 of second group of components 140 and/or the plurality of inserts 142, respectively. Protective layer 150 may include a single layer of material, two separate layers of material, or a plurality of distinct portions of a material. In a non-limiting example, as shown in FIG. 4, protective layer 150 may include a plurality of distinct portions of a material positioned between and coupled to each of the respective magnets 144, 146 and inserts 142 for coupling the magnets 144, 146 and inserts 142 together within second strap portion 118. In additional non-limiting examples, not shown, the respective magnets 144, 146 and inserts 142 may be coupled to a first surface of a single layer of protective layer 150, or may be coupled and/or sandwiched between two distinct layers of protective layer 150. In a non-limiting example, protective layer 150 may be formed from a polycarbonate material, and may be included within second strap portion 118 to protect magnets 144, 146 and inserts 142, coupled the respective magnets 144, 146 and inserts 142 together, and/or to maintain the shape of second strap portion 118 of wearable band 110. In another non-limiting example, protective layer 150 may be formed from any suitable material that may add structural support and/or stiffness to wearable band 110, such as a molded elastomer, liquid crystal polymer fibers (e.g., Vectran®), aromatic polyester fibers, para-aramid fibers (e.g., Kevlar®), polyamide fibers (e.g., Nylon®), and the like.

Additionally, second strap portion 118 may include a filler material 152. As shown in FIG. 4, filler material 152 may substantially surround first magnets 144 of first group of components 138, second magnets 146 of second group of components 140 and/or the plurality of inserts 142. Additionally, filler material 152 may substantially surround protective layer 150 of second strap portion 118. As shown in FIG. 4, filler material 152 may substantially surround magnets 144, 146, inserts 142, and/or protective layer 150, and may fill in the space between magnets 144, 146, inserts 142, and/or protective layer 150, and coupling component 126. Filler material 152 may be formed from any suitable material that may provide and/or maintain the structure of second strap portion 118 including, but not limited to, fabric, foam, rubber, molded elastomer, liquid crystal polymer fibers (e.g., Vectran®), aromatic polyester fibers, para-aramid fibers (e.g., Kevlar®), polyamide fibers (e.g., Nylon®), or the like.

Although not shown, it is understood that first strap portion 112, similar to second strap portion 118, may also include filler material 152. That is, first strap portion 112 may also include filler material 152 to substantially maintain the structure, texture, thickness and/or appearance as second strap portion 118.

Figure 5A:
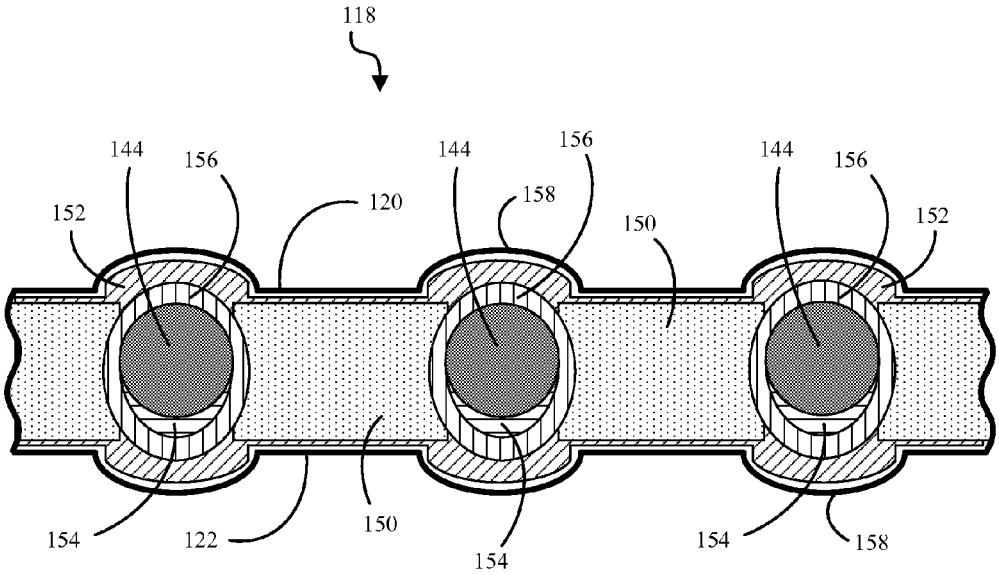
FIG. 5A shows a cross-section side view of a portion of the strap of the wearable band taken along line 5A-5A of FIG. 4, according to embodiments of the invention.
Figure 5B:
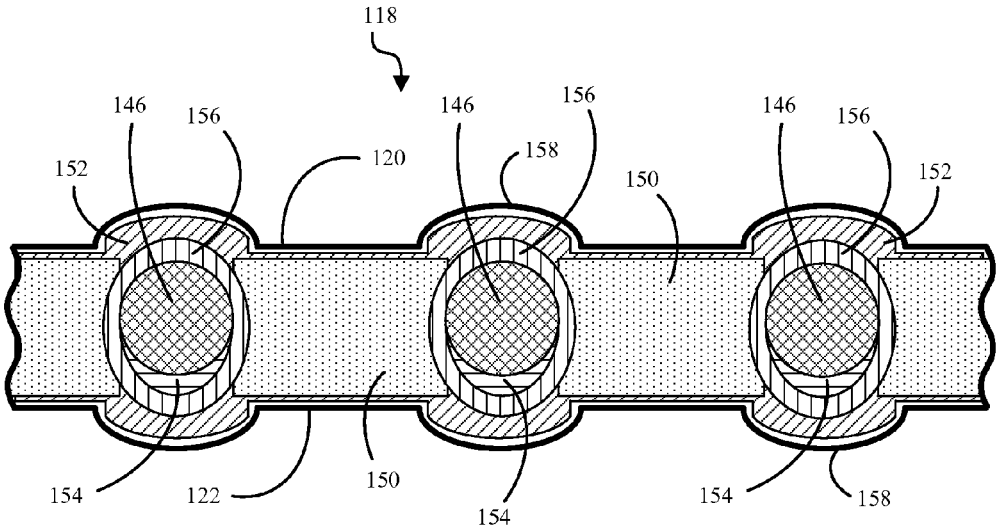
FIG. 5B shows a cross-section side view of a portion of the strap of the wearable band taken along line 5B-5B of FIG. 4, according to embodiments of the invention.

FIGS. 5A and 5B show cross-section side views of distinct portions of second strap portion 118 of wearable band 110. In a non-limiting example, FIG. 5A shows a cross-section side view of second strap portion 118 taken along line 5A-5A of FIG. 4, and depicts first magnets 144 of first group of components 138 positioned between top layer 120 and bottom layer 122 of second strap portion 118. Additionally, FIG. 5B shows a cross-section side view of second strap portion 118 taken along line 5B-5B of FIG. 4, and depicts second magnets 146 of second group of components 140 positioned between top layer 120 and bottom layer 122 of second strap portion 118. It is understood that similarly named components or similarly numbered components may function in a substantially similar fashion, may include similar materials and/or may include similar interactions with other components. Redundant explanation of these components has been omitted for clarity.

As shown in FIGS. 5A and 5B, second strap portion 118 may also include a magnetic shield 154. In non-limiting examples, a plurality of magnetic shields 154 may be coupled to or substantially surround a portion of each first magnet 144 (see, FIG. 5A) and each second magnet 146 (see, FIG. 5B), respectively. The portion of each first magnet 144 and second magnet 146 covered by magnetic shield 154 may be a bottom portion of each magnet 144, 146 positioned adjacent bottom layer 122 of second strap portion 118. As shown in FIGS. 5A and 5B, magnetic shield 154 may cover a portion of first magnets 144 and second magnets 146, respectively, positioned directly adjacent bottom layer 122. A top portion of magnets 144, 146, opposite the bottom portion covered by magnetic shield 154, may remain substantially uncovered to aid in the magnetic coupling of magnets 144, 146 and/or inserts 142 during use of wearable electronic device 100, as discussed herein. Magnetic shield 154 of second strap portion 118 may substantially block, redirect or minimize a magnetic flux in a portion of the magnets 144, 146 covered by magnetic shield 154. In the non-limiting example, magnetic shield 154 may block a portion of the magnetic flux of first magnets 144 and second magnets 146 in areas that may be exposed to foreign magnetic materials or objects, in order to prevent wearable band 110 including second strap portion 118, from being undesirably attracted or magnetically coupled to foreign objects. In a non-limiting example, magnetic shield 154 may be made from an iron alloy (e.g., steel).

Second strap portion 118 of wearable band 110 may also include a resin outer coating 156. As shown in FIGS. 5A and 5B, resin outer coating 156 may be formed around each of first magnets 144 and magnetic shield 154 (see, FIG. 5A), and second magnets 146 and magnetic shield 154 (see, FIG. 5B), respectively. Resign outer coating 156 may form a barrier around magnets 144, 146 and magnetic shield 154, and may separate magnets 144, 146 and magnetic shield 154 from distinct components (e.g., protective layer 150, filler material 152) positioned between top layer 120 and bottom layer 122 of second strap portion 118. Resin outer coating 156 may be formed using any suitable casting technique or process, and may be formed around the respective magnets 144, 146 and magnetic shield 154 to encompass both components. Additionally, Resin outer coating 156 may be formed from any suitable resin material that may formed around magnets 144, 146 and magnetic shield 154 to maintain the coupling between magnets 144, 146 and magnetic shield 154, and/or provide structure to magnets 144, 146 and magnetic shield 154 within second strap portion 118.

As shown in FIGS. 5A and 5B, top layer 120 and bottom layer 122 may include protrusions 158 positioned substantially adjacent magnets 144, 146. In a non-limiting example, the portions of top layer 120 and bottom layer 122 positioned directly above and/or below magnets 144, 146 may include protrusions 158, extending above the remaining portions of top layer 120 and bottom layer 122, respectively. Protrusions 158 may be formed in top layer 120 and bottom layer 122 as a result of the dimension of magnets 144, 146, magnetic shields 154 and/or resin outer coating 156, as well as, the hardness of each of the components (e.g., magnets 144, 146, magnetic shields 154 and so on) positioned between protrusions 158. Additionally, protrusions 158 may be formed as a result of magnets 144, 146 and/or magnetic shield 154 being formed from materials that are not substantially deformable, and/or because magnets 144, 146, magnetic shields 154 and/or resin outer coating 156 may be substantially larger than protective layer 150. However, protrusions 158 may be substantially minimal and may or may not be visible to a user of wearable band 110. That is, protrusions 158, although extending above the remaining portions of top layer 120 and below bottom layer 122 of second strap portion 118, may only extend above/below a negligible amount, such that a user of wearable band 110 including second strap portion 118 may view top layer 120 and bottom layer 122 as substantially linear surfaces. As discussed herein, protrusions 158 formed on top layer 120 and bottom layer 122 may aid in the aligning and/or magnetic coupling of second strap portion 118 when wearable electronic device 100 is coupled to a user using wearable band 110.

Turning to FIGS. 6-9, a description of how wearable band 110 functions to couple wearable electronic device 100 (see, FIG. 1) to a user may now be discussed. Specifically, FIGS. 6-9 may illustrate how a portion of second band 118 is positioned through loop 128 of first band 112 and folded back onto itself, such that second magnets 146 of second group of components 140 may be coupled to first magnets 144 of first group of components 138 and/or inserts 142 to secure wearable band 110 around a user.

Figure 6:
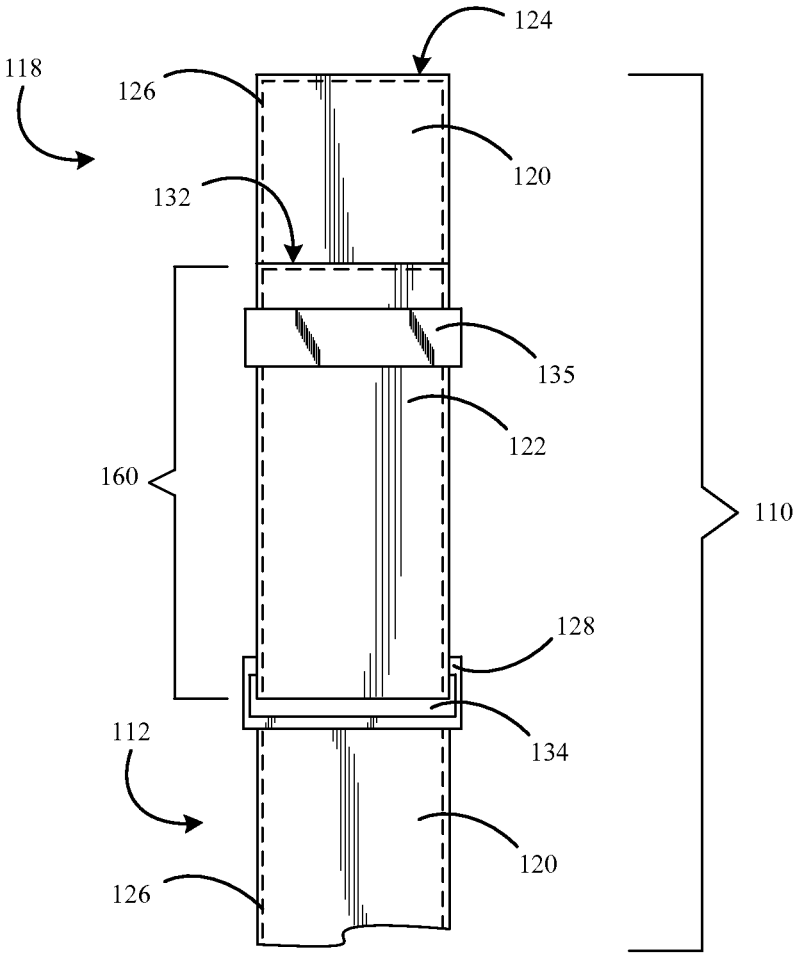
FIG. 6 shows an illustrative top view of the wearable band as shown in FIG. 2 coupled to the loop, according to embodiments of the invention.

FIG. 6 shows a top view of wearable band 110 of wearable electronic device 100 (see, FIG. 1) including second strap portion 118 coupled to first strap portion 112. More specifically, free end 132 of second strap portion 118 may be positioned or feed through opening 134 of loop 128 coupled to first strap portion 112, and may be subsequently pulled toward housing end 124 of second strap portion 118 to couple second strap portion 118 to first strap portion 112. As shown in FIG. 6, and as discussed herein, free end 132 may be feed through an opening formed by retention loop 135, and retention loop 135 may aid in securing a portion of second strap portion 118 to the remainder of second strap portion 118. Additionally, as a result of folding a portion 160 of second strap portion 118 back onto itself to couple second strap portion 118 to first strap portion 112, bottom layer 122 of the folded portion 160 may be exposed and/or facing away from a contact surface (e.g., user's skin) in which the wearable band 110 is coupled.

Figure 7:
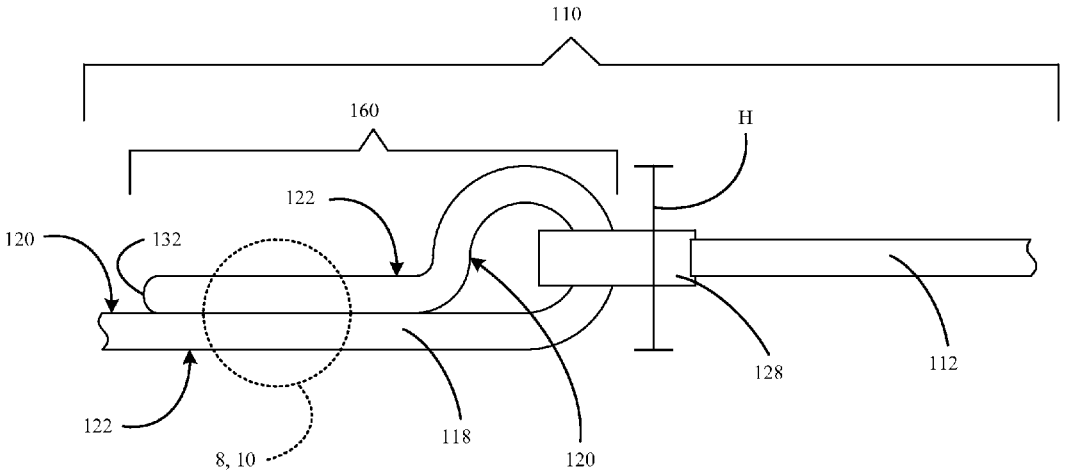
FIG. 7 shows an illustrative side view of a portion of the wearable band as shown in FIG. 6 coupled to the loop, according to embodiments of the invention.

FIG. 7 depicts a side view of a portion of wearable band including second strap portion 118 coupled to first strap portion 112. In a non-limiting example shown in FIG. 7, second strap portion 118 may be positioned or feed through opening 134 of loop 128 coupled to first strap portion 112, and may be subsequently pulled toward housing end 124 (see, FIG. 6) of second strap portion 118 to couple second strap portion 118 to first strap portion 112. As shown in FIG. 7, folded portion 160 of second strap portion 118 positioned through and/or adjacent loop 128 of first strap portion 112 may include a substantial curve in the material forming second strap portion 118 to fold folded portion 160 back onto the remaining portion of second strap portion 118. The folded portion 160 may include this curve, and ultimately may include a minimal height (H) difference within folded portion 160, as a result of magnets 144, 146 being separated and/or spaced apart. In the non-limiting example, folded portion 160 may be closely folded around loop 128 of first strap portion 112, such that the height (H) of the fold is substantially small, as a result of magnets 144, 146 being spaced apart and/or separated by the flexible material forming protective layer 150. When spaced apart, magnets 144, 146 may not substantially obstruct or limit the flexibility of second strap portion 118 by contacting each other during the folding of folded portion 160 around loop 128. The height (H) of folded portion 160 may be substantially small or negligible to avoid the undesirable catching of folding portion 160 on another object, and ultimately the uncoupling of folded portion 160 from the remaining portion of second strap portion 118.

Figure 8:
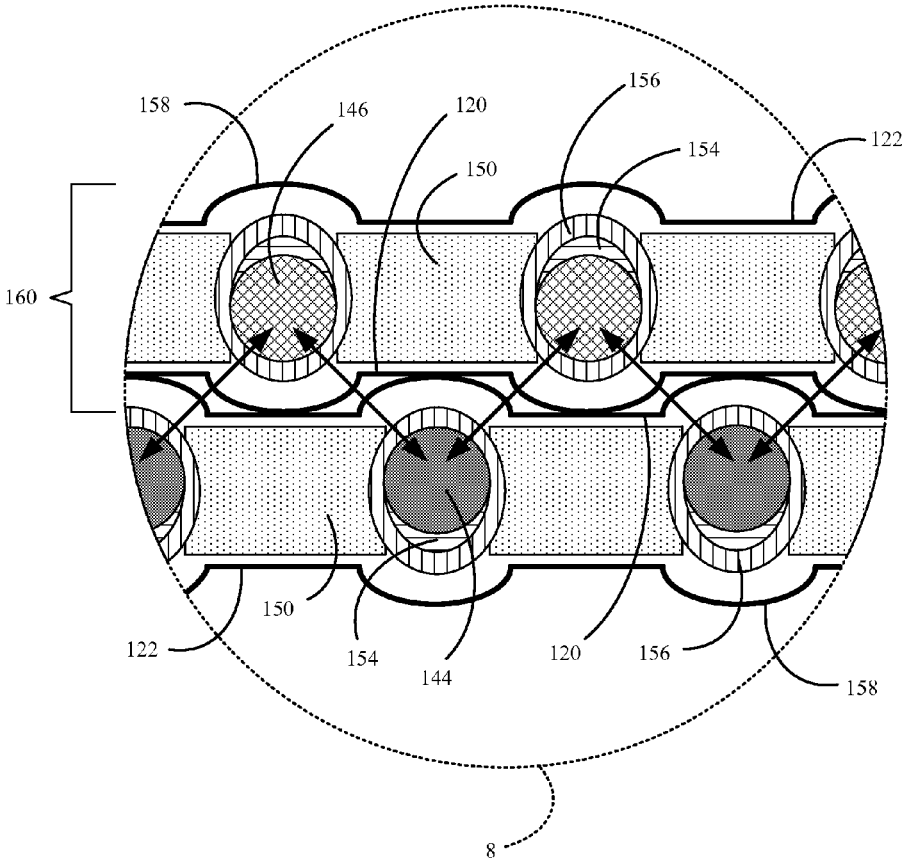
FIG. 8 shows an enlarged portion of a second strap portion of the wearable band as shown in FIG. 7 coupled to the loop, according to embodiments of the invention.

FIG. 8 shows an enlarged cross-section side view of a portion of second strap portion 118 in FIG. 7. In a non-limiting example, FIG. 8 shows a portion of fold portion 160 including second magnets 146 coupled to the remaining portion of second strap portion 118 including first magnets 144. When fold portion 160 contacts the remaining portion of second strap portion 118, the respective magnets, 144, 146 may be magnetically attracted to, and/or coupled to one another. That is, and as shown in FIG. 8, second magnets 146 included in folded portion 160 may be positioned adjacent and/or above first magnets 144 of second strap portion 118, and may be magnetically coupled to surrounding first magnets 144. The magnetic attraction between first magnet 144 and second magnet 146 may be illustrated within FIG. 8 using reference arrows. As shown in FIG. 8, and discussed in detail herein, the polarity configuration of magnets 144, 146 may result in second magnets 144 being aligned between and magnetically coupled to two distinct first magnets 146. As a result, magnets 144, 146 may be aligned in a staggered configuration as shown in FIG. 8.

Additionally as shown in FIG. 8, protrusions 158 formed on top layer 120 and bottom layer 122 of second strap portion 118 may aid in the staggered alignment of first magnets 144 and second magnets 146. Protrusions 158 of folded portion 160 may be positioned between protrusions 158 formed in the remaining portion of second strap portion 118 to align first magnets 144 with second magnets 146 in a staggered configuration. As discussed herein, the staggering of first magnets 144 and second magnets 146 may provide for a strong bond or magnetic coupling between folded portion 160 and the remaining portion of second strap portion 118.

As shown in FIG. 8, and discussed herein, protrusion 158 formed on top layer 120 of folder portion 160 of second strap portion 118 may be positioned adjacent to protrusions 158 formed on top layer 120 of the remaining portion of second strap portion 118. Additionally, bottom layer 122 in folded portion 160 and bottom layer 122 of the remaining portion of second strap portion 118 may be positioned opposite one another and/or may be exposed. As a result, and as shown in FIG. 8, magnetic shields 154 may also be positioned adjacent the exposed bottom layer 122. As discussed herein, magnetic shields 154 may be positioned adjacent the exposed bottom layer 122 when folded portion 160 is coupled to the remaining portion of second strap portion 118 to prevent wearable band 110 from being undesirably attracted to and/or magnetically coupled to foreign objects.

Figure 9:
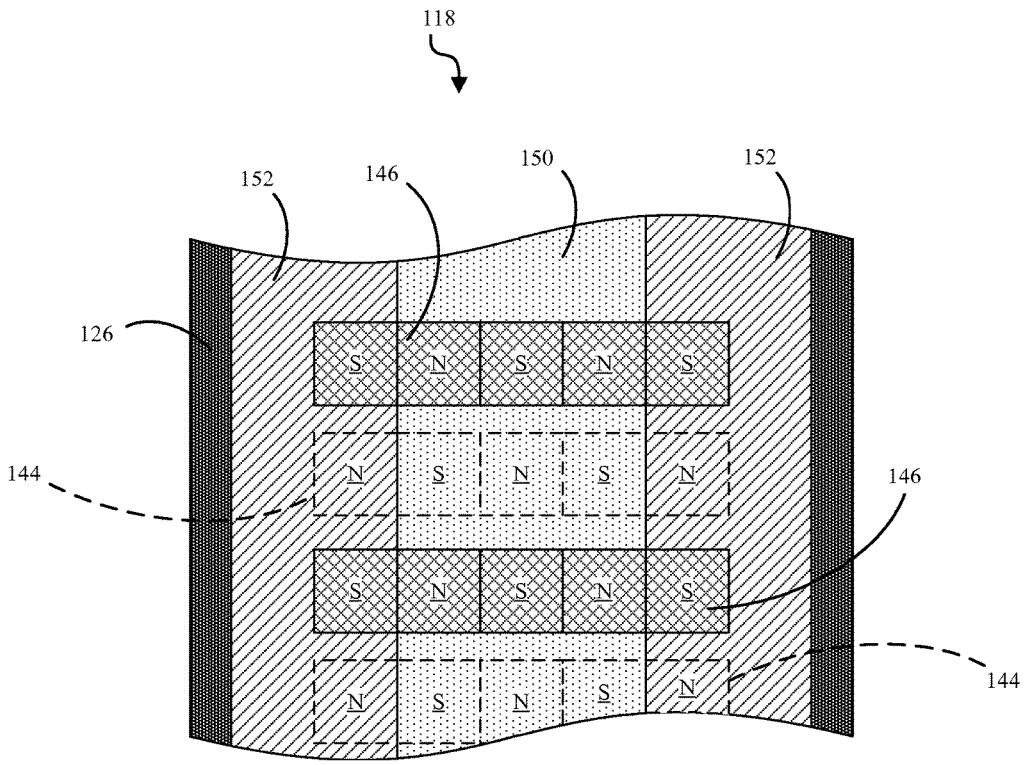
FIG. 9 shows an enlarged cross-section top view of a second strap portion of the wearable band as shown in FIGS. 6-8 coupled to the loop, according to embodiments of the invention.

FIG. 9 shows an enlarged top view of a portion of second strap portion 118 after free end 132 is fold over and positioned on the remaining portion of second strap portion 118. Top layer 120 of second strap portion 118 is removed in FIG. 9 to clearly show the alignment of first magnets 144 (shown in phantom), and second magnets 146 in folded portion 160 of second strap 118. As shown in FIG. 9, first magnets 144 and second magnets 146 may be magnetized and/or include various alternating magnetic fields or polarities (e.g., north (N), south (S)) over the length of the magnet. In a non-limiting example, first magnets 144 may include a first configuration of alternating magnetic fields over the length of the magnet, and second magnets 146 may include a second configuration of alternating magnetic fields over the length of the magnet, distinct from the first configuration of first magnets 144. As shown in FIG. 9, each of the individual magnetic fields of the second configuration of alternating magnetic fields for second magnets 146 may include a magnetic polarity opposite to a corresponding individual magnet field of the first configuration of alternating magnetic fields for first magnets 144.

The configuration of magnetic fields for first magnets 144 and second magnets 146 may be opposite one another to form a magnetic attraction or magnetic bond between the respective magnets, as discussed herein. In a non-limiting example, each individual portion of second magnet 146 includes a polarity that may be magnetically attracted to and/or magnetically bonded to a corresponding portion of first magnet 144 including an opposite polarity. Additionally, as a result of spacing the magnets apart, within second strap portion 118, each second magnet 146 may be positioned between and may be magnetically attracted to and/or magnetically bonded to two first magnets 144 positioned on either side of second magnet 146. This may ultimately result in a strong magnetic bond between folded portion 160 of second strap portion 118 and the remaining portion of second strap portion 118 when wearable band 110 is coupled to a user's wrist. Finally, the first and second configurations of the magnetic fields for each of first magnets 144 and second magnets 146 may allow folded portion 160 of second strap portion 118 to be aligned with the remaining portion of second strap portion 118 during magnetic bonding or coupling. In the non-limiting example shown in FIG. 9, both first magnets 144 and second magnets 146 include a plurality of alternating, and opposite, magnetic fields throughout the entire length of the respective magnets. As a result, second magnets 146 may be aligned with, and magnetically bonded to first magnets 144 in such a way that all portions are magnetically bonded or attracted. Furthermore, when magnetically bonded, the magnetic field configurations of first magnets 144 and second magnets 146 may not only align the respective magnets, but may also align the edges of folded portion 160 and the remaining portion of second strap portion 118 when wearable band 110 is coupled to a user.

Figure 10:
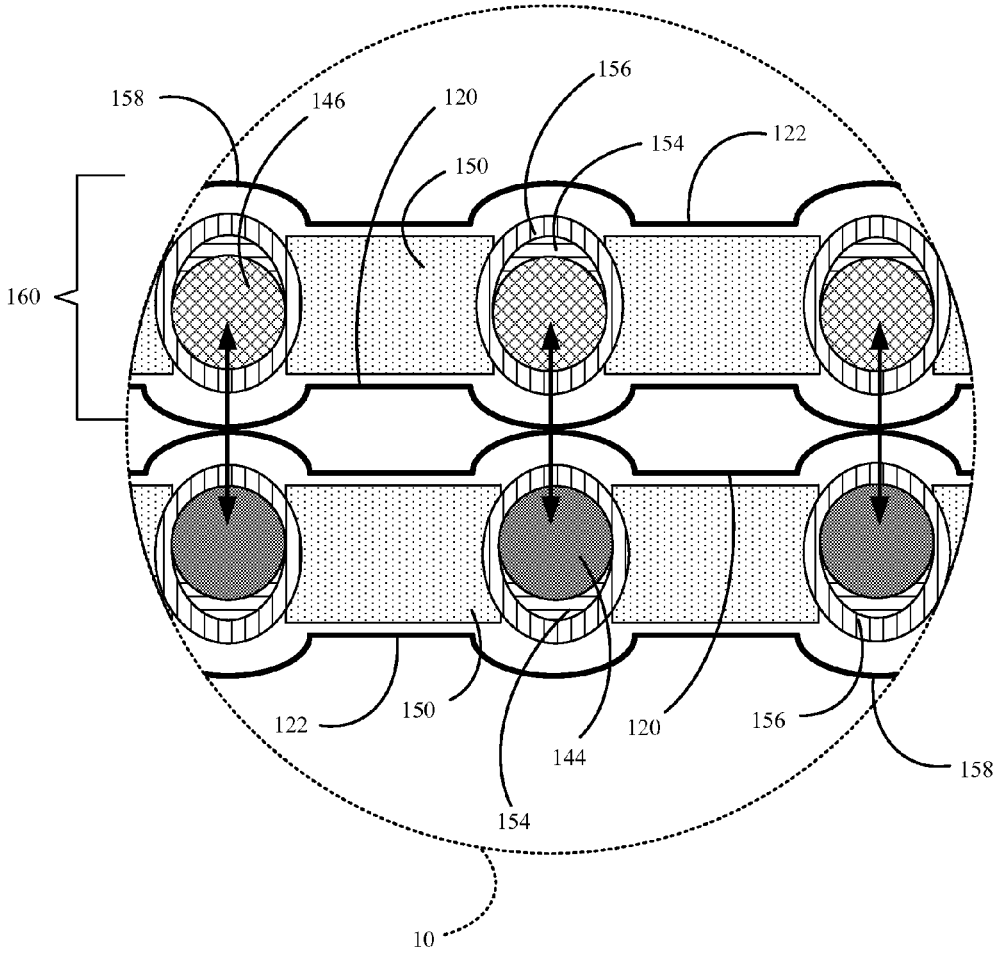
FIG. 10 shows an enlarged portion of a second strap portion of the wearable band as shown in FIG. 7 coupled to the loop, according to additional embodiments of the invention.

In an additional non-limiting example, protrusions 158 of top layer 120 and bottom layer 122 of the respective strap portions may be substantially aligned and/or contacting when utilizing wearable band 110. FIG. 10 shows an enlarged cross-section side view of a portion of second strap portion 118 in FIG. 7, according to another embodiment. In a non-limiting example shown in FIG. 10, a portion of fold portion 160 including second magnets 146 may be coupled to the remaining portion of second strap portion 118 including first magnets 144. Like FIG. 8, the respective magnets 144, 146 may be magnetically attracted to, and/or coupled to one another, as illustrated in FIG. 10 using reference arrows. Distinct from FIG. 8, protrusions 158 of second strap portion 118 may be in substantial alignment and/or may contact each other when folded portion 160 of second strap portion 118 is magnetically coupled to the remaining portion of second strap portion 118. In the non-limiting example, the polarity configuration of magnets 144, 146 may result in first magnets 146 being aligned directly above and magnetically coupled to a single, corresponding second magnets 144. As a result, and compared to FIG. 8, each of the first magnets 144 may be aligned in a common vertical plane as a corresponding second magnet 146 as shown in FIG. 10. Additionally, each protrusion 158 of folded portion 160 may also be aligned in a common vertical plane with a corresponding protrusion 158 in the remaining portion of second strap portion 118, and no protrusions 158 included in the folded portion 160 may be positioned between two distinct protrusions 158 of the remaining portion of second strap portion 118. As discussed herein, a common vertical plane may be understood as a vertical plane passing through a top and bottom magnet and/or protrusions with respect to the orientation and positioning shown in FIG. 10.

As shown in FIG. 10, and as discussed herein, protrusion 158 formed on top layer 120 of folder portion 160 of second strap portion 118 may be positioned adjacent to, and substantially aligned with, corresponding protrusions 158 formed on top layer 120 of the remaining portion of second strap portion 118. Additionally, bottom layer 122 in folded portion 160 and bottom layer 122 of the remaining portion of second strap portion 118 may be positioned opposite one another, aligned and/or exposed. As a result, and as shown in FIG. 10, magnetic shields 154 may also be positioned adjacent the exposed bottom layer 122. As discussed herein, magnetic shields 154 may be positioned adjacent the exposed bottom layer 122 when folded portion 160 is coupled to the remaining portion of second strap portion 118.

As similarly discussed herein with respect to FIG. 9, first magnets 144 and second magnets 146 may be magnetized and/or include various alternating magnetic fields or polarities (e.g., north (N), south (S)) over the length of the magnet. In a non-limiting example, first magnets 144 may include a first configuration of alternating magnetic fields over the length of the magnet, and second magnets 146 may include a second configuration of alternating magnetic fields over the length of the magnet, distinct from the first configuration of first magnets 144. Each of the individual magnetic fields of the second configuration of alternating magnetic fields for second magnets 146 may include a magnetic polarity opposite to a corresponding individual magnet field of the first configuration of alternating magnetic fields for first magnets 144.

The configuration of magnetic fields for first magnets 144 and second magnets 146 may be opposite one another to form a magnetic attraction or magnetic bond between the respective magnets, as discussed herein. In a non-limiting example, each individual portion of second magnet 146 including a first polarity may be magnetically attracted to and/or magnetically bonded to a corresponding portion of first magnet 144 including an opposite polarity. Additionally, as a result of the configuration of the magnets within second strap portion 118, each second magnet 146 may be aligned in a common plane and may be magnetically attracted to and/or magnetically bonded to a single, corresponding first magnet 144 directly below second magnet 146.

Although not shown in FIG. 10, it is understood that the magnetic attraction and/or the coupling of the folded portion 160 and the remaining portion of second strap portion 118 may cause at least a partial deformation in wearable band 110. As a result of the flexible and/or elastic material used to form at least a portion of second strap portion 118, aligned and contacting protrusions 158 of second strap portion 118 may be deformed, such that second strap portion 118 is substantially flat or linear. The deformation of protrusions 158 may be based on the magnetic attraction and/or magnetic coupling formed between the magnets 144, 146 of wearable band 110.

Although shown herein as including two distinct straps (e.g., first strap portion 112, second strap portion 118), wearable band may be formed from a single strap. In a non-limiting example shown in FIG. 11, wearable band 1010 may be formed as a single strap, such that first strap portion 1012 and second strap portion 1018 may be integrally formed. It is understood that similarly named components or similarly numbered components may function in a substantially similar fashion, may include similar materials and/or may include similar interactions with other components. Redundant explanation of these components has been omitted for clarity.

As discussed herein, wearable band 1010 may be formed from a single piece of material. That is, wearable band 1010 may be formed from a single piece of material (e.g., leather), where top layer 1020 is folded over and positioned above bottom layer 1022 (not shown) to form wearable band 1010. Where wearable band 1010 is formed from a single piece of material, the fold in the material to differentiate between top layer 1020 and bottom layer 1022 may be positioned at end 1030, adjacent loop 1028. The single piece of material forming wearable band 1010 may be feed through loop 1028 of wearable band 1010, and loop 1028 may be partially positioned between top layer 1020 and bottom layer 1022, and secured at end 1030 of wearable band 1010. In another non-limiting example, not shown, single strap wearable band 1010 may be formed from two pieces of material, where each piece of material forms a respective layer (e.g., top, bottom) of wearable band 1010.

Figure 11:
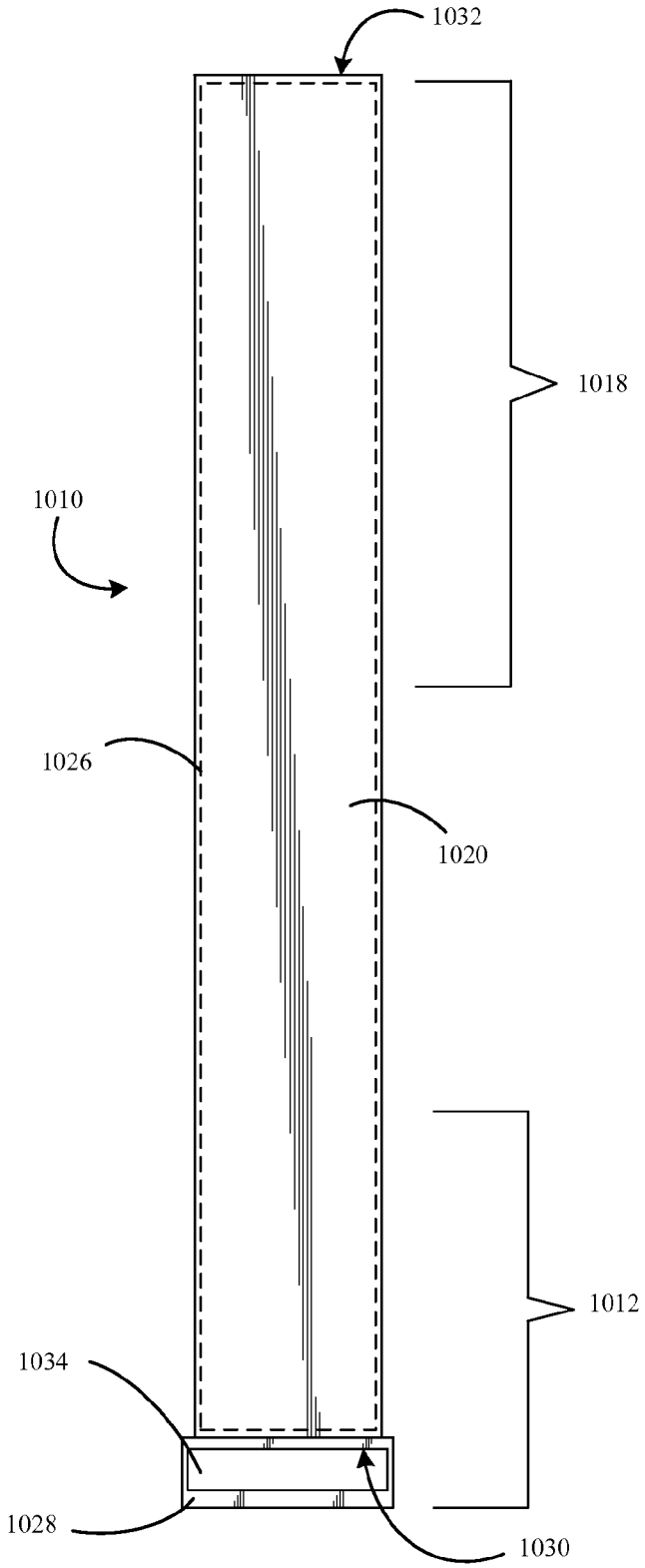
FIG. 11 shows an illustrative top view of a wearable band, according to embodiments of the invention.

Wearable band 1010, as shown in FIG. 11, may function substantially similar to wearable band 110 discussed herein with respect to FIGS. 1-10. That is, wearable band 1010 may include free end 1032 positioned opposite, and capable of being positioned through loop 1028 to be folded back onto a remaining portion of wearable band 1010 to couple wearable electronic device 100 (see, FIG. 1) to a user. Although not shown, it is understood that second strap portion 1018 of wearable band 1010 may include a similar internal configuration as second strap portion 118 discussed herein with respect to FIG. 4. In a non-limiting example, wearable band 1010 may also include a first group of components (e.g., first magnets), a second group of components (e.g., second magnets) and a plurality of inserts positioned between the first and second group of components. The first and second group of components and plurality of inserts may be utilized to couple a folded portion of second strap portion 1018 to a remaining portion of wearable band 1010 to ultimately couple wearable electronic device 100 to a user, as discussed herein with respect to FIGS. 1-10.

Figure 12:
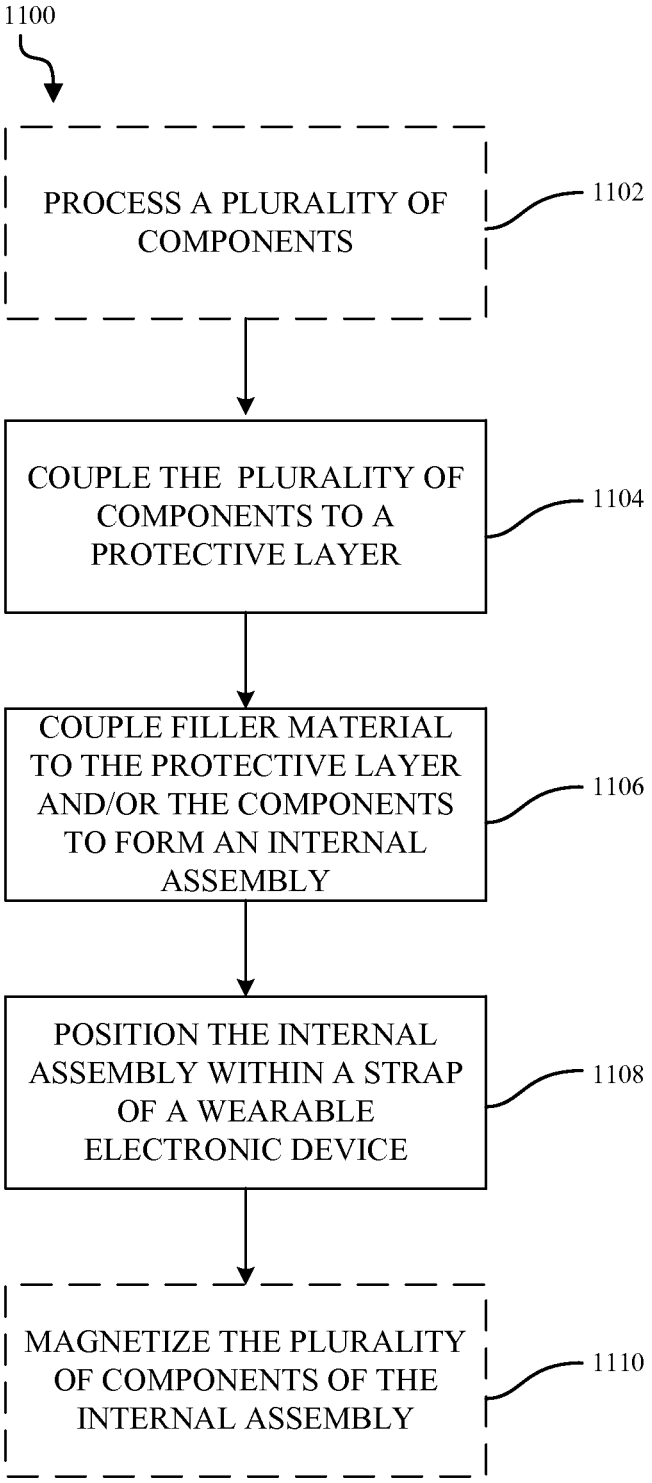
FIG. 12 shows a flow chart illustrating a method of forming a wearable band for an electronic device. This method may form the wearable band as shown in FIGS. 1-11.

FIG. 12 depicts an example process for forming a wearable band for a wearable electronic device. Specifically, FIG. 12 is a flowchart depicting one example process 1100 for forming a wearable band for a wearable electronic device. In some cases, the process may be used to form one or more wearable bands, as discussed above with respect to FIGS. 1-11.

In a preliminary, optional operation 1102 (shown in phantom) a plurality of components may be processed. More specifically, at least a portion of a plurality of components having magnetic properties may undergo preliminary processes. The processing of at least a portion of the plurality of components may include at least one of coupling a magnetic shield to at least one side of at least the portion of the plurality of components, and/or forming a resin coating around at least the portion of the plurality of components. Additionally, the resin coating formed around the components may also be formed around the magnetic shield, where a magnet shield is coupled to at least one side of at least the portion of the plurality of components.

In operation 1104, a plurality of components may be coupled to a protective layer. The plurality of components may include magnetic properties. The coupling of the plurality of components may include coupling a first group of magnets to the protective layer, and coupling a second group of magnets to the protective layer opposite the first group of magnets. The first and second group of magnets may or may not be magnetized when coupled to the protective layer. The coupling of operation 1104 may also include coupling a plurality of inserts to the protective layer between the first group of magnets and the second group of magnets. Like the first and second group of magnets, the plurality of inserts may include magnetic properties (e.g., magnetic field, magnetic attraction, and so on). Additionally, the coupling of the plurality of components to the protective layer may also include positioning at least a portion of the protective layer between each of the components (e.g., first and second group of magnets, inserts). Each of the first group of magnets, second group of magnets and plurality of inserts may be spaced apart from one another, and/or may be separated by a portion of the protective layer.

In operation 1106, a filler material may be coupled to at least one of the protective layer and/or plurality of components. More specifically, a filler material may be coupled to at least one of the first group of magnets, the second group of magnets, the plurality of inserts and/or the protective layer. Filler material may be coupled to the respective components (e.g., magnets, inserts, protective layer) to form substantially a perimeter around the components. The coupling of the filler material to the protective layer and/or plurality of components may also result in the formation of an internal assembly. The internal assembly may include the first group of magnets, the second group of magnets, the plurality of inserts, the protective layer and the filler material.

In operation 1108, the internal assembly may be positioned within a strap of a wearable electronic device. More specifically, the internal assembly, including the first and second group of magnets, the inserts, the protective layer and the filler material, may be positioned and/or secured within a strap of a wearable electronic device. The strap may be formed from a single piece of material, or a plurality of pieces of material. Where the strap is formed from a single piece of material, the positioning of the internal assembly in operation 1108 may further include positioning the internal assembly on an inner surface of a bottom layer of the strap, and subsequently folding a top layer of the strap over the internal assembly and bottom layer. Additionally, the strap may be formed as a single strap that may be coupled to the wearable electronic device, or strap may be formed from multiple pieces, that may be individually coupled to the wearable electronic device.

In operation 1110 (shown in phantom), at least a portion of the plurality of components of the internal assembly may be magnetized. That is, the first group of magnets and second group of magnets, if not magnetized already, may undergo an magnetizing process. The magnetizing of the portion of components included in the internal assembly may include magnetizing the first group of magnets to have a first unique pattern of polarities, and magnetizing the second group of magnets to have a second unique pattern of polarities, distinct and/or opposite from the first unique pattern of polarities of the first group of magnets. The first group and second group of magnets may include distinct and/or opposite polarities so that the second group of magnets may be magnetically coupled to the first group of magnets during use of the wearable band. Additionally, the distinct and/or opposite polarities between the first and second group of magnets may aid in the alignment of the portions of the band including the respective magnets during use of the wearable band. The second group of magnets may also be magnetically coupled to and/or attracted to the plurality of inserts including magnetic properties.

Although not shown, the internal assembly and/or the strap may undergo additional process for forming a wearable band for a wearable electronic device. For example, at least a portion of the strap may be cut. In a non-limiting example, the strap may undergo a cutting process, where at least a portion of the strap is cut. The strap may be cut to alter the length, and/or width of the strap to a specific or desired dimension. Additionally, a free end of the strap that may be folded back onto a portion of the strap to couple to wearable band to a user may also be cut so that the free end visually and/or cosmetically matches the width of the remaining portion of the wearable band. The strap may be cut prior to positioning the internal assembly within the strap, or subsequent to positioning the internal assembly within the strap.

An additional process not shown may include bonding the edges of the strap including the internal assembly. More specifically, subsequent to positioning the internal assembly within the strap, the edges of the top layer and the bottom layer forming the strap may be bonded together to maintain the internal assembly within the strap. The edges may be bonded using any suitable bonding component or technique. In non-limiting examples, the edges of the strap may be bonded using an adhesive or by stitching the top layer to the bottom layer using a thread positioned through the respective layers adjacent the edges of the strap.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A watch band comprising:

a first strap portion including a loop; and a second strap portion insertable through the loop of the first strap portion, the second strap portion including first magnets and second magnets, wherein each of the first magnets lies beneath a first protrusion on a first surface of the second strap portion, each of the second magnets lies beneath a second protrusion on a second surface of the second strap portion, the first magnets and the second magnets are arranged to be magnetically coupled to each other in a first alignment relative to each other while the second strap portion is in a first folded state with the first protrusions overlapping the second protrusions, and the first magnets and the second magnets are further arranged to be magnetically coupled to each other in a second alignment relative to each other, different than the first alignment, while the second strap portion is in a second folded state with the first protrusions extending into gaps between adjacent pairs of the second protrusions.

2. The watch band of claim 1, wherein the first magnets include a first magnets having a first magnetic field.

3. The watch band of claim 2, wherein the second magnets include a second magnets having a second magnetic field, distinct from the first magnetic field.

4. The watch band of claim 3, wherein the second magnetic field of the second magnets is stronger than the first magnetic field of the first magnets.

5. The watch band of claim 3, wherein the second magnets includes an enlarged magnet positioned directly adjacent a second end of the second strap portion, the enlarged magnet substantially larger than a remainder of the second magnets.

6. The watch band of claim 1, wherein the loop of the first strap portion is formed from a material having magnetic properties.

7. The watch band of claim 6, wherein the loop of the first strap portion is formed from a ferrous metal material.

8. The watch band of claim 1 further comprising inserts positioned between the first magnets and the second magnets, the inserts including magnetic properties.

9. The watch band of claim 8, wherein a number of the first magnets is larger than at least one of:

a number of the second magnets; and a number of inserts forming the inserts.

10. The watch band of claim 1, wherein a first length of the second strap portion having the first magnets comprises approximately half of a second length of the second strap portion having the second magnets.

11. The watch band of claim 1, wherein over a second length of the second strap portion having the second magnets comprises at least approximately a quarter of a total length of the second strap portion.

12. A watch comprising:

a housing; and a watch band coupled to the housing, the watch band including:

a first strap portion including a loop coupled to the housing; and a second strap portion coupled to the housing, opposite the first strap portion, the second strap portion including:

first magnets each having a first magnetic polarity;

second magnets each having a second magnetic polarity, opposite the first magnetic polarity; and inserts each formed of a magnetically attractable metal and positioned between the first magnets and the second magnets, wherein the second magnets are attracted to the first magnets and at least some of the inserts when the second strap portion is folded onto itself.

13. The watch of claim 12, wherein the first strap portion and the second strap portion are formed from leather material.

14. The watch of claim 12, wherein the second strap portion further comprises:

a top layer; and a bottom layer positioned opposite the top layer, wherein the top layer and the bottom layer are one of:

formed from distinct pieces of material, or formed from a single piece of material.

15. The watch of claim 14, wherein the first magnets, the second magnets and the inserts are positioned between the top layer and the bottom layer of the second strap portion.

16. The watch of claim 12, wherein the second strap portion further comprises a filler material substantially surrounding at least one of:

the first magnets;

the second magnets; and the inserts.

17. The watch of claim 16, wherein the first strap portion includes the filler material.

18. The watch of claim 12, wherein the second strap portion further comprises a protective layer at least one of:

coupled to the first magnets, the second magnets and the inserts, respectively; and positioned between the first magnets, the second magnets and the inserts, respectively.

19. The watch of claim 18, wherein the protective layer is formed from a polycarbonate.

20. The watch of claim 12, wherein the loop is integrally formed with the first strap portion.

21. The watch of claim 20, wherein the loop includes reinforcing fibers positioned:

around an entire circumference of the loop, or within two opposite portions of the circumference of the loop.

22. The watch of claim 21, wherein the reinforcing fibers include magnetic properties.

23. The watch of claim 12, wherein the second strap portion includes a length of excess material between an end and the second magnets.

24. The watch of claim 12, wherein the second magnets are magnetically coupled to at least one of:

the first magnets; and the inserts.

25. The watch of claim 12, wherein the second strap portion further comprises a magnetic shield coupled to a bottom side of:

the first magnets; and the second magnets.

26. The watch of claim 25, wherein the magnetic shield is formed from steel.

27. The watch of claim 25, wherein the second strap portion further comprises a resin outer coating positioned around:

the first magnets and the magnetic shield; and the second magnets and the magnetic shield.

28. A watch band comprising:

a first strap portion including a loop formed of a magnetically attractable metal; and a second strap portion insertable through the loop of the first strap portion, the second strap portion including first magnets and second magnets arranged to be magnetically coupled to each other when the second strap is folded onto itself, wherein one of the second magnets is an enlarged magnet that is positioned at a free end of the second strap, produces a stronger magnetic field than each of a remainder of the second magnets, and becomes magnetically coupled to the loop when the free end of the second strap passes through the loop.

29. The watch band of claim 28, further comprising:

inserts each formed of a magnetically attractable metal and positioned between the first magnets and the second magnets, wherein the second magnets are attracted to the first magnets and at least some of the inserts when the second strap portion is folded onto itself.

* * * * *